United States Patent [19]

Küpper

[11] Patent Number: 4,907,688

[45] Date of Patent: Mar. 13, 1990

[54] DEVICE FOR THE TRANSFER OF BOBBINS FROM A CONVEYOR BELT WITH A LARGE LOADING CAPACITY TO A BOBBIN CONVEYOR WITH A SMALL LOADING CAPACITY

[75] Inventor: Wilhelm Küpper, Wegberg, Fed. Rep. of Germany

[73] Assignee: W. Schlafhorst & Co., Münchengladbach, Fed. Rep. of Germany

[21] Appl. No.: 220,916

[22] Filed: Jul. 18, 1988

Related U.S. Application Data

[62] Division of Ser. No. 907,066, Sep. 12, 1986, abandoned.

[30] Foreign Application Priority Data

Sep. 14, 1985 [DE] Fed. Rep. of Germany ..... 3532915

[51] Int. Cl.[4] ..... B65G 47/04

[52] U.S. Cl. ..... 198/463.4; 242/35.5 A; 198/464.3; 198/532

[58] Field of Search ..... 198/463.6, 357, 358, 198/356, 524, 464.3, 452, 532, 463.4; 242/35.5 A

[56] References Cited

U.S. PATENT DOCUMENTS

| | | | |
|---|---|---|---|
| 3,698,536 | 10/1972 | Pray et al. | 198/803.12 X |
| 3,917,049 | 11/1975 | Shirai et al. | 198/448 |
| 3,998,320 | 12/1976 | Eggert | 198/532 X |
| 4,181,228 | 1/1980 | Hashimoto et al. | 242/35.5 A |
| 4,432,198 | 2/1984 | D'Agnolo | 242/35.5 A X |
| 4,586,668 | 5/1986 | Mori | 242/35.5 A |
| 4,624,360 | 11/1986 | Walk et al. | 242/35.5 A X |
| 4,660,369 | 4/1987 | Konshi et al. | 198/346.2 X |

FOREIGN PATENT DOCUMENTS

| | | | |
|---|---|---|---|
| 2630438 | 4/1978 | Fed. Rep. of Germany | 198/463.6 |

*Primary Examiner*—Robert J. Spar
*Assistant Examiner*—D. Glenn Dayoan
*Attorney, Agent, or Firm*—Herbert L. Lerner; Laurence A. Greenberg

[57] ABSTRACT

An assembly for the orderly and sequentially timed transport of bobbins includes a bobbin producing machine, at least one conveyor belt with a given load capacity and bobbin carrying capacity downstream of the bobbin producing machine in bobbin travel direction, a switching device for the conveyor belt, a controllable individual bobbin retaining device downstream of the conveyor belt including a bobbin retaining element, a bobbin transporter downstream of the bobbin retaining device with a load capacity and bobbin carrying capacity being smaller than the given capacities, the bobbin transporter including receiving elements for individual bobbins, and a device for operating the bobbin transporter in step with the conveyor belt, such as in the form of a timing device of the bobbin transporter and/or a sensor controlling the switching device of the conveyor belt.

15 Claims, 4 Drawing Sheets

DEVICE FOR THE TRANSFER OF BOBBINS FROM A CONVEYOR BELT WITH A LARGE LOADING CAPACITY TO A BOBBIN CONVEYOR WITH A SMALL LOADING CAPACITY

This application is a division of application Ser. No. 907,066, filed Sept. 12, 1986, now abandoned.

The invention relates to a device for the orderly and sequentially timed individual transport of bobbins from a bobbin producing machine with at least one conveyor belt having a switching device, a relatively large loading capacity and a relatively large bobbin carrying capacity, to a bobbin transporter with a relatively small loading capacity and a relatively small bobbin carrying capacity, the transporter having receiving means for individual bobbins and operating in step with the conveyor belt.

If an automatically cycled bobbin transporter with a relatively small loading capacity and bobbin carrying capacity requests a bobbin from an automatically cycled conveyor with large loading capacity and large bobbin carrying capacity, delays in the delivery of the bobbins occur because the conveyor belt requires starting time. Due to the great belt length of the conveyor belt, the various deflection and friction points and because of the great weight of a fully loaded conveyor belt which may carry 500 bobbins, for example, the acceleration time and the subsequent braking time of the conveyor belt is relatively great, so that limits are set on the rate of the work cycle which cannot be exceeded, although the bobbin transporter may be capable of a considerably shorter cycle times.

It is accordingly an object of the invention to provide a device for the transfer of bobbins from a conveyor belt with a large loading capacity to a bobbin conveyor with a small loading capacity, which overcomes the hereinafore-mentioned disadvantages of the heretofore-known devices of this general type and to shorten the cycle time during the transfer of the bobbins from the conveyor belt to the bobbin transporter, without generating disturbances during the transfer.

With the foregoing and other objects in view there is provided, in accordance with the invention, an assembly for the orderly and sequentially timed transport of bobbins or cops, comprising a bobbin producing machine, at least one conveyor belt with a given load capacity and bobbin carrying capacity downstream of the bobbin producing machine in bobbin travel direction, a switching device for the conveyor belt, a controllable individual bobbin retaining device downstream of the conveyor belt including a bobbin retaining element, a bobbin transporter downstream of the bobbin retaining device with a load capacity and bobbin carrying capacity being smaller than the given capacities, the bobbin transporter including receiving means for individual bobbins, and means for operating the bobbin transporter in step with the conveyor belt, in the form of a switching device of the bobbin transporter and/or a sensor controling the timing device of the conveyor belt.

The invention accomplishes a very desirable reduction of the cycle time. The bobbin transporter is supplied with bobbins from the bobbin retaining device without any delays. The bobbin retaining device itself can be disposed very close to the bobbin transporter so that only a very short travelling time need be allowed in the cycle. The sensor which registers the presence of a bobbin in the bobbin retaining device, or the control device of the bobbin transporter can now request a new bobbin from the bobbin conveyor during the time that the bobbin transporter starts its motion. The renewed refilling of the bobbin retaining device is performed during the total travel time of the bobbin transporter up to its next stop, so that the conveyor belt can immediately be started, a feature which is impossible without the invention.

As a whole the desired reduction of the cycle time and the desired increase in the number of cycles per unit time is achieved without the danger of disturbances during the transfer operations.

In accordance with another feature of the invention, the individual bobbin retaining device is in the form of a loading chute into which the conveyor belt delivers bobbins in sequence one after the other, and the bobbin transporter includes a bobbin centralizing sleeve below the bobbin retaining device.

The individual bobbin retaining device or loading chute can be disposed directly at the bobbin delivery end of the conveyor belt. The bobbin centralizing sleeve of the bobbin transporter in turn can be disposed directly under the bobbin retaining device. However, this is not always possible, so that this feature also includes the possibility of a lateral displacement between the bobbin retaining device and the bobbin centralizing sleeve.

In accordance with a further feature of the invention, the bobbin centralizing sleeve includes movable wall elements and an operating device for laterally withdrawing the wall elements, and including means for preventing advancement of the bobbin transporter until the wall elements are laterally withdrawn, and a sensor of the bobbin centralizing sleeve being associated with the bobbin transporter for differentiating between filled and empty receiving means or elements and controlling the bobbin retaining element of the bobbin retaining device. This helps to reduce the cycle time.

Therefore the time which elapses until a bobbin is reliably accepted by the receiving element of the bobbin transporter is reduced. The centering of the bobbins is very reliably performed and the bobbin centralizing sleeve cannot be over filled.

In accordance with an added feature of the invention, the operating device for the wall elements is controlled by the sensor. The sensor recognizes if a bobbin has been accepted, and then immediately operates the wall elements, thereby initiating the cycling motion of the bobbin transporter and at the same moment that the sensor recognizes an empty receiving element it requests a new bobbin from the bobbin retaining device and in some case also turns on the bobbin conveyor belt which requires a certain time to get started.

In accordance with an additional feature of the invention, the wall elements of the bobbin centralizing sleeve are in the form of laterally pivotal flaps or fingers.

In accordance with yet another feature of the invention, a thread remnant cutting device is disposed below the bobbin retaining device. This is done in order to prevent disturbances of the bobbin transport caused by dragging threads. In the most simple form such a thread remnant cutting device is formed of a blade which is disposed along the side of the path which the bobbin travels, against the edge of which the thread is pressed during the motion of the bobbin, so that the remaining thread is severed by the applied tension. However, it is more reliable to use controllable thread scissors, which perform a cutting motion after each discharge of a bobbin by the bobbin retaining device, regardless of whether a thread remnant is present or not.

In accordance with yet a further feature of the invention, the bobbin retaining device is movable or pivotal between a bobbin receiving position in the vicinity of the conveyor belt and a bobbin delivery position and includes an operating or pivot device, and including a bobbin presence sensor controlling the operating means. This is done because a lateral displacement between the bobbin retaining device and the bobbin centralizing sleeve, for example, is also sometimes of advantage, as explained below.

It is advantageous if the bobbin receiving position is disposed at the bobbin delivery end of the conveyor belt. For example, the bobbin presence sensor which operates in conjunction with the bobbin retaining device, may control the operating or pivot device to move in the direction toward the bobbin discharge position, after it has registered the presence of a bobbin. However, after discharging this bobbin, it registers the absence of the bobbin, and directs the operating or pivot device so that the bobbin retaining device moves as rapidly as possible to the bobbin accepting position. Simultaneously, or with a predetermined delay, the same bobbin presence sensor also controls the cycle control device of the conveyor belt, in order to deliver a new bobbin to the bobbin retaining device.

In accordance with yet an additional feature of the invention, the at least one conveyor belt is in the form of first and second conveyor belts, and the bobbin receiving position is in the vicinity of at least one of the first and second conveyor belts. The bobbin retaining device can be pivoted back and forth from a receiving position in the vicinity of the first conveyor belt, and a receiving position in the vicinity of the second conveyor band into a bobbin discharge position. This embodiment of the invention is of advantage in double-sided machines, which are provided with a bobbin transport belt at each machine side.

In accordance with still another feature of the invention, the bobbin transporter includes a common bobbin centralizing sleeve below the bobbin retaining device, the bobbin delivery position being disposed above the bobbin centralizing sleeve.

It is advantageous if the bobbin discharge position of the bobbin retaining device lies above the bobbin centralizing sleeve of the bobbin transporter. Thereby shorter transport distances can be achieved.

In accordance with yet an added feature of the invention, the conveyor belts have bobbin discharge ends, and the bobbin centralizing sleeve and the bobbin discharge position are disposed between said bobbin discharge ends of said conveyor belts. This structure results in a pivot path. If the bobbin centralizing sleeve is disposed exactly in the middle between the bobbin delivery ends of the transport belts, equally long pivot motions can be used.

In accordance with still a further feature of the invention, the bobbin retaining device is movable or pivotal between the bobbin receiving position which is in the vicinity of the first conveyor belt and the bobbin delivery position above the bobbin centralizing sleeve, and including another bobbin retaining device having an operating or pivot device and a bobbin presence sensor controlling the operating device, the other bobbin retaining device being movable between the bobbin receiving position which is in the vicinity of the second conveyor belt and the bobbin delivery position.

The combined motion of the bobbin retaining devices has various advantages. For example, both conveyor belts are to be emptied at the same time, the cycling time can be shortened considerably and in this case the cycling time depends only on the shortest possible cycle time of the bobbin transporter.

While one bobbin retaining device is ready to give off a bobbin or has already delivered it to the bobbin transporter, the other bobbin retaining device is already ready to receive a bobbin or has already done so, and after one bobbin is delivered after the shared pivot motion of the two bobbin retaining devices, the other bobbin can be delivered, so that one of the two bobbin retaining devices is again at the bobbin acceptance position near the other conveyor belt.

On the other hand, it is also possible with the same device to clear only one conveyor belt.

In accordance with yet an additional feature of the invention, there is provided an additional individual bobbin retaining device disposed at the bobbin discharge end of one of the conveyor belts having a bobbin retaining element being controlled by the bobbin retaining element of the bobbin retaining device disposed downstream thereof, and the additional bobbin retaining device including a bobbin presence sensor controlling the switching device of the one conveyor belt. This construction can lead to a further reduction of the cycle time.

Therefore the bobbin retaining device which feeds the bobbin centralizing sleeve of the bobbin transporter does not receive its bobbins from the conveyor belt, but from an additional bobbin retaining device; which was refilled with plenty time available to do so.

According to this embodiment of the invention, if there is only one conveyor belt, there are two bobbin retaining devices disposed in series. If there are two conveyor belts at a double-sided bobbin producing machine, there are at least three individual bobbin retaining devices provided. Of these two are disposed at the bobbin delivery ends of the conveyor belts, while one, and in some case two pivotal bobbin retaining devices working together supply the bobbin centralizing sleeve.

In accordance with a concomitant feature of the invention, the at least one conveyor belt is in the form of at least two conveyor belts each having a switching device and feeding the controllable bobbin retaining device in common, the bobbin presence sensor selectively controlling the switching device of a respective one or at least two of the conveyor belts.

The bobbins are conducted to the individual bobbin retainer on slides or through tubes. This provides a quite simple yet still reliable structure.

Other features which are considered as characteristic for the invention are set forth in the appended claims.

Although the invention is illustrated and described herein as embodied in a device for the transfer of bobbins from a conveyor belt with a large loading capacity to a bobbin conveyor with a small loading capacity, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
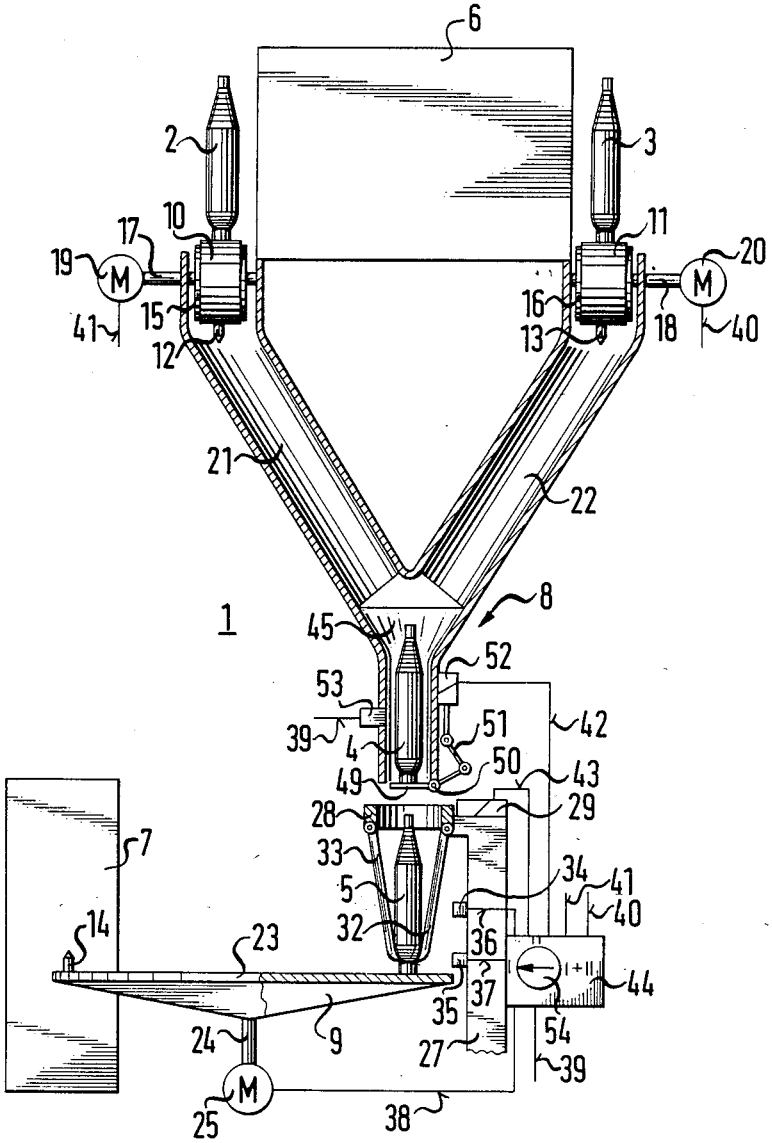
FIG. 1 is a fragmentary, diagrammatic, side-elevational view of a first embodiment of the invention.

Referring now to the figures of the drawings in detail and first, particularly, to FIG. 1 thereof, there is seen a machine unit 1 formed of a two-sided ring-spinning machine 6 which produces cops or bobbins 2, 3 on both sides thereof, and which is followed by a winding machine 7. The two machines are interconnected by a device which is designated as a whole with reference numeral 8 and serves for the orderly transfer of the bobbins 2–5 which were produced by the ring spinning machine 6, to a bobbin transporter or conveyor 9, which in turn conducts the bobbins to a winding machine 7.

A respective conveyor belt 10.11 is disposed at each side of the ring-spinning machine 6. Each of the two conveyor belts is provided with receiving means 12, 13 in the form of mounting pins for the respective bobbins 2,3. The conveyor belt 10 is driven by a belt roller 15 and the conveyor band 11 is driven by a belt roller 16. A shaft 17 of the roller 15 is driven in steps by a motor or switching device 19, in such a way that the receiving means 12 always advance a distance equal to the spacing between the pins, so that one bobbin is always transferred into a chute 21. In the same way, a shaft 18 of the roller 16 is driven step by step by a motor or switching device 20, in such a manner that the receiving means 13 advances one spacing between pins, so that one bobbin is discharged into a chute 22 with its base or foot forward.

The bobbin transporter 9 is provided with a disc 23 on which receiving means 14 in the form of mounting pins are disposed in a circle, so that a central shaft 24 of the disc can be driven in programmed steps by a motor 25, in such a way that the receiving means 14, only one of which is shown, always advances one spacing between mounting pins.

Figure 6:
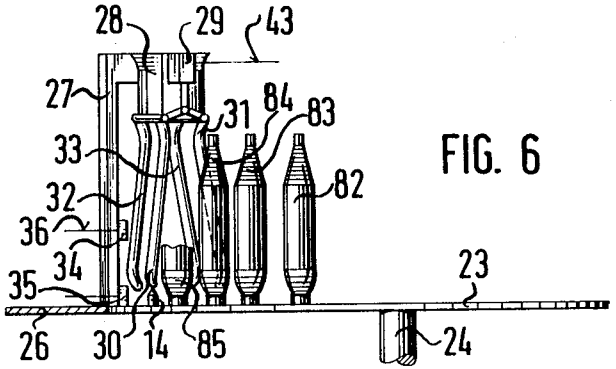
FIGS. 5 and 6 are side-elevational views showing details which apply to all embodiments of the invention.
Figure 5:
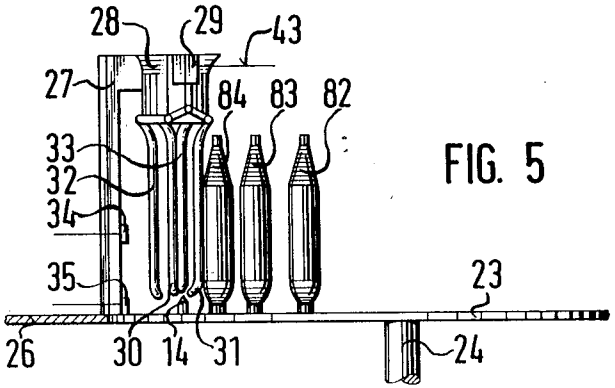

According to FIGS. 1, 5 and 6, a carrier or support 27 is fastened at a table 26 which surrounds the disc 23 and a bobbin centralizing sleeve 28 is fastened to the carrier bracket 27. According to FIGS. 5 and 6, the bobbin centralizing sleeve 28 is provided with wall-elements 30 to 33, which are disposed in pairs and are activated by an operating device 29 in the form of an electro-magnetic drive, so that they can move laterally out of the way.

A sensor or timing device formed of sensor elements 34 and 35 which can differentiate between a filled and an empty receiving element 14 of the bobbin transporter 9, is provided at the carrier bracket 27. Respective functional or operative connections 36 and 37 connect the sensor elements 34 and 35 to a control or switching device 44. The same control device 44 is connected to the motors 25, 20 and 19 by functional or operative connections 38, 40 and 41. A functional or operative connection 43 is also provided from the operating device 29 of the bobbin centralizing sleeve 28 to the control device 44.

The two conveyor belts 10 and 11 have a common controllable individual bobbin retaining or holding back device 45. The individual bobbin retaining or hold-back device 45 has a bobbin retaining or hold-back element 49 in the form of a flap which can pivot about an axis 50 and which can be operated by an electro-magnetic drive 52 through a linkage 51. The electro-magnetic drive 52 is connected by a functional or operative connection 42 with the control device 44. Furthermore, the individual bobbin retaining device 45 is provided with a sensor 53 which senses the presence of a bobbin and is connected with the control device 44 through a functional or operative connection 39.

The sensors mentioned above may be opto-electrical sensors, for instance.

The control device 44 contains all of the electronic and/or electro-mechanical switching means for accomplishing the following functions:

The control device of the bobbin transporter 9 controls the motor 25 through the functional connection 38 and causes it to step the disc 23 forward one mounting pin spacing of the receiving means 14. This motion takes place counter-clockwise, when the sensor element 34 detects the presence of a bobbin on the mounting pin under the centralizing sleeve 28, such as the bobbin 5 according to FIG. 1. As soon as the sensing element 35 detects the presence of other receiving means under the bobbin centralizing sleeve 28 at the end of the movement of the bobbin transporter 9 and the other sensing element 34 does not report the presence of a bobbin, the sensor element 35 causes the activation of the electro-magnetic drive 52 through the functional connection 42 and opens the bobbin retaining element 49. In this way according to FIG. 1, for example, the bobbin 4 drops into the bobbin centering sleeve 28 and after the bobbin sensor 53 detects the absence of the bobbin 4, it causes the motor 19 to advance the conveyor belt 10 one pin division of the receiving means 12 through the functional connection 39 and the control device 44, because the pointer-shaped knob of a switch 54 of the control device 44 is in a position I. At this position of the switch 54, the bobbin retainer 45 only operates in conjunction with the motor 19 of the conveyor belt 10 to empty the conveyor belt. The other conveyor belt 11 is therefore at rest. However, if the pointer-shaped knob of the switch 54 is in a position II, the bobbin retaining device 45 operates exclusively with the motor 20 of the conveyor belt 11. Finally, if the pointer-shaped knob of the switch 54 is in the position I + II, whenever the bobbin sensor 53 reports the absence of a bobbin, the motor 19 is activated one time and the next time the motor 20 is alternatingly activated in order to empty both conveyor belts 10 and 11.

The bobbin presence sensor 53 is always activated for only one switching operation. It is only activated if it detects the presence of a new bobbin in the bobbin retaining or hold-back device 45 after a bobbin was requested.

After the bobbin retaining element 49 is activated or opens, it only remains open for a short time and automatically closes itself again. For example, the closing may be effected by a return spring inside the electro-magnetic drive 52 which works in conjunction with a timing element.

Every time the sensor element 34 detects the presence of a bobbin, such as the presence of the bobbin 5 in the centralizing sleeve 28, the sensor activates the operating device or electromagnetic drive 29 through a functional connection 43, so that the wall elements 30 to 33 are spread apart and they do not obstruct the travel of the bobbin 5 on its circular path. Thereafter, the wall elements 30 to 33 return to their original position automatically, in order to resume guidance of the centering of a bobbin on one of the receiving means 14 of the disc 23.

Figure 2:
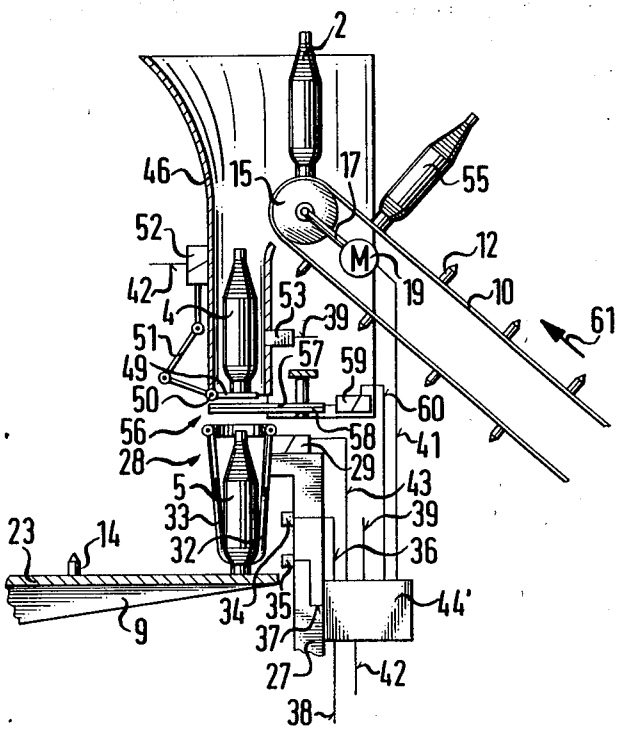
FIG. 2 is a view similar to FIG. 1 of second embodiment of the invention.

In the second embodiment of the invention according to FIG. 2, several parts which have already been explained with regard to the first embodiment are present, such as the conveyor belt 10 with its receiving means 12, the roller 15 with the shaft 17, the motor 19, the bobbin transporter 9 with the disc 23 and the bobbin centralizing sleeve 28 with some of its accessories.

FIG. 2 shows that the conveyor belt 10 runs in an upwardly slanted direction and that an additional bobbin 55 follows directly behind the mounted bobbin 2.

In the FIG. 2 embodiment, a retaining device 46 for individual bobbins is located at the end of the conveyor belt 10 it is also constructed like a chute and has the same individual parts as the bobbin retaining device 45 of the preceding embodiment.

A thread cutting device 56 is disposed below the bobbin retaining device 46 for cutting off thread remnants. The thread cutting device 56 is formed of two blades 57, 58 of a pair of scissors which can be opened and closed by an electro-magnetic drive 59. The electromagnetic drive 59 is connected to a control device which is designated in the FIG. 2 embodiment by reference numeral 44', through a functional or operative connection 60.

According to FIG. 2, the bobbin centering sleeve 28 has just accepted the bobbin 5. This is registered by the sensor element 34, which thereafter causes the following events to occur with the aid of the control device 44':

The motor 25 which is only shown in FIG. 1, is started. At the same time the electro-magnetic drive 59 is operated through the functional connection 60 for a short time and the thread cutting device or scissors 56 for removing thread remnants are therefore closed and opened again, in order to remove a thread which may have been dragging behind.

After the bobbin 5 has travelled further on, the sensor element 34 detects that the receiving means 14 under the bobbin centralizing sleeve 28 is empty, and then operates the electro-magnetic drive 52 through the functional connection 42, so that the bobbin retaining element 49 releases the bobbin 4 and it can fall into the bobbin centralizing sleeve 28. Thereafter, when the bobbin presence sensor 53 detects the absence of the bobbin 4, it causes the motor 19 to advance the conveyor belt 10 a distance equal to the spacing of the mounting pins in the direction of an arrow 61, by way of the functional connections 39 and 41.

After the bobbin 4 has dropped down, the bobbin retaining element 49 closes again and the next following bobbin 2 can be accepted by the bobbin retaining device 46.

The third embodiment according to FIGS. 3 and 4 differs from the first embodiment according to FIG. 1 as follows:

The device 8 of the machine unit 1 in the third embodiment has two bobbin retaining or hold-back devices 47 and 48 which pivot together. The first device can move between a bobbin receiving position in the vicinity of the first conveyor belt 10 and a bobbin discharge position, which is located above the bobbin centralizing sleeve 28. The second bobbin retaining device can move between a bobbin receiving position in the vicinity of the second conveyor belt 11 and the same bobbin discharge position.

Figure 3:
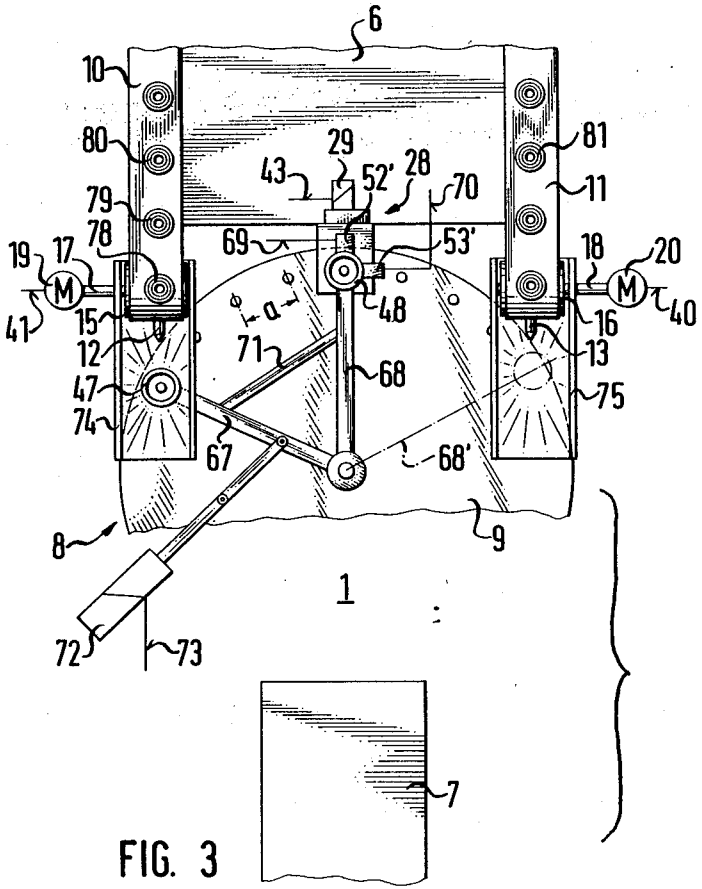
FIG. 3 is a top-plan view of a third embodiment of the invention.

FIG. 3 shows that the bobbin retaining device 47 is in the bobbin receiving position and the bobbin retaining device 48 is in the bobbin discharge position.

Figure 4:
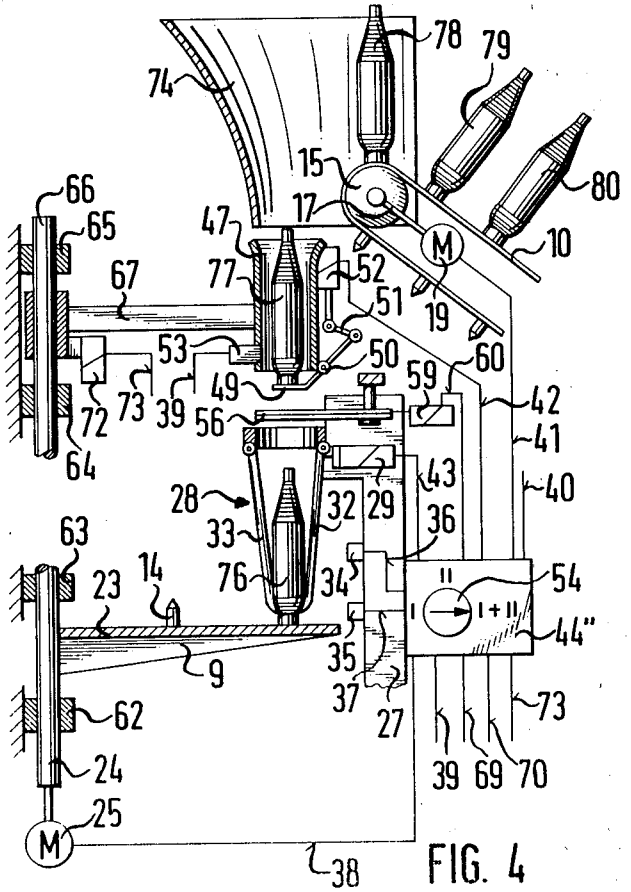
FIG. 4 is a side-elevational view of the FIG. 3 embodiment.

According to FIG. 4, the shaft 24 of the bobbin transporter 9 is supported in stationary bearings 62 and 63. Vertically above the shaft 24, a second shaft 66 is also supported in stationary bearings and two levers 67 and 68 are attached to the second shaft. The lever 67 carries the bobbin retaining device 47 and the lever 68 carries the bobbin retaining device 48. Otherwise the bobbin retaining devices are constructed like the bobbin retaining device 45 according to FIG. 1. The electro-magnetic drive of the bobbin retaining element of the bobbin retaining device 48 is designated with reference numeral 52 in FIG. 3. The drive 52 is connected to a control device which is designated with reference numeral 44'' in FIG. 4, through a functional or operative connection 69. The sensor which registers the presence of a bobbin in the bobbin retaining device 48 is designated with reference numeral 53' in FIG. 3. A functional or operative connection 70 connects the sensor 53' to the control device 44''.

For stabilization, the two levers 67 and 68 are connected with each other by a crossbar 71. A common operating or pivot device of the two individual bobbin retaining devices 47 and 48 is constructed as an electromagnetic unit and is designated with reference numeral 72. The device 72 is connected to the control device 44'' by a functional or operative connection 73.

A funnel 74 is disposed at the bobbin discharge end of the conveyor belt 10. The bobbin retaining device 47 is located directly below the funnel 74.

The device 56 for cutting remaining threads, which is described above with regard to the embodiment according to FIG. 2, is disposed above the bobbin centralizing sleeve 28 according to FIG. 4. The electro-magnetic drive 59 is connected with the control device 44'' by the functional connection 60.

The common pivot device 72 is controlled by the bobbin presence sensors 53 and 53, in such a way that the sensor positioned above the bobbin centralizing sleeve always controls the pivot device 72. According to FIG. 3, the bobbin presence sensor 53' performs this function. Meanwhile, the other bobbin presence sensor controls the switching device of the respective conveyor belt. Accordingly, in the embodiment at hand, the bobbin presence sensor 53 controls the stepping motor 19 of the conveyor belt 10, when it registers the absence of a bobbin in the bobbin receiving position. The selection of the respective sensor 53 for controlling the pivot device 72 and the correct motor 19 or 20 is effected by a non-illustrated switching device which is influenced by the respective position of the levers 67 and 68.

Similar to the first embodiment according to FIG. 1, it can be determined with the aid of the switch 54 if only the conveyor belt 10 or 11 is to be emptied, or if both conveyor belts should alternatingly deliver their bobbins.

According to FIG. 4, the switch 54 is in the position I + II. A bobbin 76 has just been delivered into the bobbin centralizing sleeve 28. Consequently, the bobbin retaining device 48, which is only shown in FIG. 3, does contain a bobbin. However the other retaining device 47 has already requested and received a bobbin 77 from the conveyor belt. At this moment the conveyor belt 10 has already stopped again. The thread-end cutting device 56 has already been operated to cut off a thread which may be dragged along and is again in the open position.

The sensor element 34, which therefore detects the presence of the bobbin 76, causes the motor 25 to advance the bobbin transporter 9 one mounting pin distance. In FIG. 3 the division distances are designated with reference symbol a and are all equal. The sensing element 34 simultaneously activates the operating device 29 and expands the wall elements of the bobbin centralizing sleeve 28. So that the bobbin transporter 9 can advance one division without obstruction.

After the bobbin presence sensor 53' has registered the absence of the bobbin 76, it causes the shifting of the pivot device 72, through the functional connections 70 and 73 and the control device 44", so that the lever 68 moves to the position 68' and the bobbin retaining device 48 moves under the funnel 75. The other bobbin retaining device 47 then moves into the position previously occupied by the bobbin retaining device 48. The bobbin transfer operation subsequently repeats, but now the conveyor belt 11 delivers a bobbin.

If the pointer-shaped knob of the switch 54 is moved to the position I, only the conveyor belt 10 can be emptied. In this case the bobbin retaining device 48 is not used. If the switch 54 is moved to position II, only the conveyor belt 11 can be emptied. In this case the bobbin retaining device 47 is not used, but goes through its motion. As already mentioned above, that the bobbin transporter 9 or its disc 23 advances counter-clockwise. FIG. 5 indicates that the bobbins 82, 83, 84 are sequentially mounted onto the receiving means 14. The bobbin centralizing sleeve 28 is ready to receive the next bobbin. FIG. 6 shows the moment at which the bobbin centralizing sleeve 28 has received the next bobbin 85 and its wall elements 30 to 33 are already spread apart to permit the further advance of the disc 23.

Figure 7:
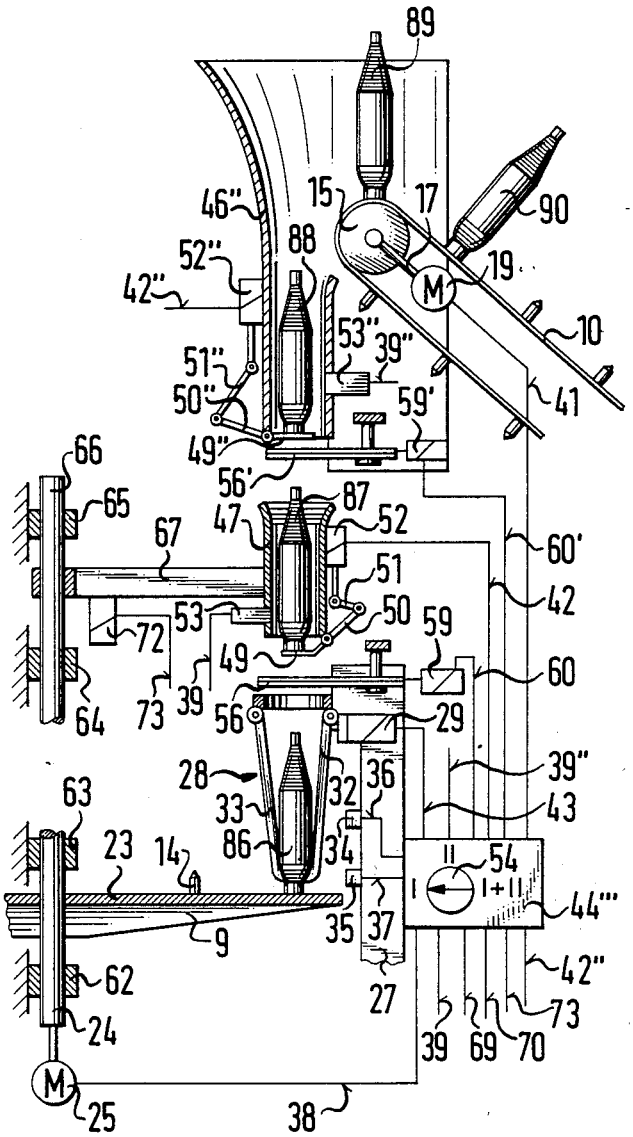
FIG. 7 is another view similar to FIG. 1 showing a fourth embodiment of the invention.

The fourth embodiment of the invention according to FIG. 7 is only a variation of the third embodiment according to FIGS. 3 and 4. Therefore, what was said for the third embodiment generally applies to the fourth embodiment as well. The differences are as follows:

An additional controllable bobbin retaining or hold-back device is provided at the bobbin discharge end of each respective conveyor belt. For example, FIG. 7 shows that a bobbin retaining device 46" is disposed at the bobbin discharge end of conveyor belt 10, which is constructed exactly like the bobbin retaining device 46 of the second embodiment according to FIG. 2. In order to facilitate differentiation, all of the parts of the device 46" carry a double prime.

A bobbin retaining or hold-back element 49" of the bobbin retaining device 46" can be controlled by the bobbin presence sensor 53 of the bobbin retaining device 47 disposed downstream thereof. For this purpose, functional connections 39, 42" are provided from the bobbin presence sensor 53 of the bobbin retaining device 47 and the electro-magnetic drive 52" of the bobbin retaining device 46" to the control device 44'.

Similar to the second embodiment according to FIG. 2, the bobbin presence sensor 53" controls the switching stepping device of the first conveyor belt 10, which in this case is the motor 19. Functional connections 39" and 41 which lead through the control device 44"' are provided in FIG. 7 for carrying out this function.

As opposed to the third embodiment, the pointer-shaped knob of the switch 54 according to FIG. 7 is in the position I. This means that only the conveyor belt 10 is to be emptied. Consequently, only the pivoting bobbin retaining device 47 and the stationary bobbin retaining device 46" are in operation. The pivotable bobbin retaining device 48, which is not shown in FIG. 7, is not in operation and the other stationary bobbin retaining device is positioned at the bobbin discharge end of the other conveyor belt which is also not shown in FIG. 7.

FIG. 7 shows that a second thread-remnant cutting device 56' is disposed below the bobbin retaining device 46" and the electro-magnetic drive 59' thereof is connected to the control device 44"' by a functional connection 60'. The two thread cutting devices 56 and 56' have already performed their cutting function and are again in the open position. The circuits are technically constructed in such a way that the sensor element 34 controls both thread cutting devices 56 and 56'.

For clarification of the drawing, in FIG. 7 the disc 23 has not yet advanced one index step, which normally would have been the case. However, the same sensor element 34 according to FIG. 7 has already shifted the pivot device 72, so that the bobbin retaining device 47 is already positioned vertically below the bobbin retaining device 46". The bobbin retaining device 47 has already received a bobbin from the bobbin 87 from the bobbin retaining device 46". Therefore, a second cutting operation might have been caused by the bobbin presence sensor 53 of the bobbin retaining device 47 and performed by the thread remnant cutting device 56.

FIG. 7 also shows that the bobbin retaining device 46" has already received a bobbin 88 from the conveyor belt 10. Additional bobbins 89 and 90 are ready on the conveyor belt 10 for the next two deliveries.

After it has registered the presence of the bobbin 87, the bobbin presence sensor 53 shifts the pivot device 72 into the other position, so that the bobbin retaining device 47 again moves into the bobbin discharge position above the bobbin centralizing sleeve 28. As soon as the sensing element 35 registers the arrival of the next empty receiving means 14 below the bobbin centralizing sleeve 28, the above-described work cycle starts again from the beginning.

The foregoing is a description corresponding in substance to German application No. P 35 32 915.7, dated Sept. 14, 1985, the International priority of which is being claimed for the instant application, and which is hereby made part of this application. Any material discrepancies between the foregoing specification and the aforementioned corresponding German application are to be resolved in favor of the latter.

I claim:

1. Assembly for the orderly and sequentially timed transport of bobbins, comprising a bobbin producing machine, first and second conveyor belts with a given load capacity and a given bobbin carrying capacity downstream of said bobbin producing machine in a bobbin travel direction, a switching device for switching said conveyor belts on and off, a controllable individual bobbin retaining device downstream of said conveyor belts including a bobbin retaining element, said bobbin retaining device being movable between a bobbin receiving position in the vicinity of at least one of said first and second conveyor belts and a bobbin delivery position, a bobbin transporter downstream of said bobbin retaining device with a load capacity and bobbin carrying capacity being smaller than said given load and bobbin carrying capacities, said bobbin transporter including receiving means for individual bobbins, means for operating said bobbin transporter in step with said conveyor belts, said operating means including a bobbin presence sensor causing said bobbin transporter to advance if a bobbin is present and causing said retaining element to open if a bobbin is not present at a given location on said bobbin transporter, said bobbin retaining device being in the form of a loading chute into which said conveyor belts deliver bobbins in sequence one after the other, and said bobbin transporter including a bobbin centralizing sleeve below said bobbin retaining device, said bobbin delivery position being disposed above said bobbin centralizing sleeve.

2. Assembly according to claim 1, wherein said operating means is in the form of a device for timing operation of said bobbin transporter.

3. Assembly according to claim 1, wherein said operating means is in the form of a sensor controlling said switching device of said conveyor belts.

4. Assembly according to claim 1, wherein said operating means is in the form of a for device timing operation of said bobbin transporter and a sensor controlling said switching device of said conveyor belts.

5. Assembly according to claim 1, wherein said bobbin centralizing sleeve includes movable wall elements and an operating device for laterally withdrawing said wall elements, and including means for preventing advancement of said bobbin transporter until said wall elements are laterally withdrawn.

6. Assembly according to claim 5, wherein said operating device for said wall elements is controlled by said bobbin presence sensor.

7. Assembly according to claim 5, wherein said wall elements of said bobbin centralizing sleeve are in the form of laterally pivotal flaps.

8. Assembly according to claim 5, wherein said wall elements of said bobbin centralizing sleeve are in the form of laterally pivotal fingers.

9. Assembly according to claim 1, including a thread remnant cutting device disposed below said bobbin retaining device.

10. Assembly according to claim 1, wherein said conveyor belts have bobbin discharge ends, and said bobbin centralizing sleeve and said bobbin delivery position are disposed between said bobbin discharge ends of said conveyor belts.

11. Assembly according to claim 10, wherein said bobbin retaining device is movable between said bobbin receiving position which is in the vicinity of said first conveyor belt and said bobbin delivery position above said bobbin centralizing sleeve, and including another bobbin retaining device being movable between another bobbin receiving position which is in the vicinity of said second conveyor belt and said bobbin delivery position, an operating device for moving said bobbin retaining devices between said bobbin receiving positions and said bobbin delivery position, and another bobbin presence sensor causing one of said conveyor belts to deliver a bobbin to one of said bobbin retaining devices and causing said operating device to transfer the bobbin to said bobbin transporter with said one of said bobbin retaining devices, if a bobbin is not present in said one of said bobbin retaining devices.

12. Assembly for the orderly and sequentially timed transport of bobbins, comprising a bobbin producing machine, first and second conveyor belts with a given bobbin load capacity, each of said belts including means spaced apart by a given distance for receiving individual bobbins from said bobbin producing machine, first and second switching devices for sequentially switching said first and second conveyor belts respectively by said given distance, a bobbin transporter with a bobbin load capacity smaller than said given bobbin load capacity, said bobbin transporter having means for receiving individual bobbins, first and second individual bobbin retaining devices disposed between said conveyor belts and said bobbin transporter, said bobbin retaining devices being in the form of loading chutes into which said conveyor belts deliver bobbins in sequence one after the other, a common operating device for moving said first bobbin retaining device between a bobbin receiving position in the vicinity of said first conveyor belt and a bobbin delivery position and for moving said second bobbin retaining device between another bobbin receiving position in the vicinity of said second conveyor belt and said bobbin delivery position, said bobbin retaining devices having bobbin presence sensors controlling said operating device and said conveyor belts, a bobbin centralizing sleeve disposed between said bobbin delivery position and said bobbin transporter, said centralizing sleeve including wall elements, and another operating device controlling said wall elements, said bobbin transporter having timing devices for moving said bobbin transporter in steps and for operating said other operating device and said bobbin retaining devices.

13. Assembly according to claim 12, wherein said conveyor belts have bobbin discharge ends, and said bobbin centralizing sleeve and said bobbin delivery position are disposed between said bobbin discharge ends of said conveyor belts.

14. Assembly according to claim 12, including levers attached to said bobbin retaining devices, and a common shaft attached to said levers.

15. Assembly according to claim 12, wherein one of said bobbin presence sensors is disposed above the bobbin centralizing sleeve, said common operating device is always exclusively controlled by said one bobbin presence sensor, and said switching devices are controlled by the other of said bobbin presence sensors.

* * * * *